US007467927B2

(12) United States Patent
Wood

(10) Patent No.: US 7,467,927 B2
(45) Date of Patent: Dec. 23, 2008

(54) PUMPING ARRANGEMENT

(75) Inventor: Nigel Charles Wood, Burntwood (GB)

(73) Assignee: ITW Limited, Berkshire (GB)

( * ) Notice: Subject to any disclaimer, the term of this patent is extended or adjusted under 35 U.S.C. 154(b) by 803 days.

(21) Appl. No.: 10/381,021

(22) PCT Filed: Jul. 24, 2002

(86) PCT No.: PCT/GB02/03376

§ 371 (c)(1),
(2), (4) Date: Jul. 21, 2003

(87) PCT Pub. No.: WO03/012296

PCT Pub. Date: Feb. 13, 2003

(65) Prior Publication Data

US 2004/0001765 A1 Jan. 1, 2004

(30) Foreign Application Priority Data

Jul. 31, 2001 (GB) ..... 0118616.2

(51) Int. Cl.
*F04B 49/06* (2006.01)

(52) U.S. Cl. ..... 417/44.1

(58) Field of Classification Search ..... 417/415, 417/534, 44.1, 540; 138/26
See application file for complete search history.

(56) References Cited

U.S. PATENT DOCUMENTS

| | | | | |
|---|---|---|---|---|
| 1,713,219 | A | 5/1929 | Eisenhauer et al. | |
| 4,093,404 | A | 6/1978 | Gerken et al. | |
| 4,359,312 | A * | 11/1982 | Funke et al. | 417/18 |
| 4,614,027 | A | 9/1986 | Morrow | |
| 6,068,448 | A * | 5/2000 | Muratsubaki et al. | 417/44.2 |
| 6,074,170 | A * | 6/2000 | Bert et al. | 417/44.2 |
| 6,089,837 | A * | 7/2000 | Cornell | 417/540 |
| 6,139,288 | A | 10/2000 | Karasawa | |
| 6,168,824 | B1 | 1/2001 | Rozan et al. | |
| 6,175,210 | B1 * | 1/2001 | Schwartz et al. | 318/801 |
| 6,318,978 | B1 * | 11/2001 | Burns | 417/540 |

FOREIGN PATENT DOCUMENTS

| | | | |
|---|---|---|---|
| JP | 57-162232 | U | 10/1982 |
| JP | 10-281056 | A | 10/1998 |
| JP | 2000-233127 | A | 8/2000 |
| JP | 2001-115950 | A | 4/2001 |
| JP | 2001-124282 | A | 5/2001 |
| WO | WO 00 32932 | A | 6/2000 |

OTHER PUBLICATIONS

Notice of Reasons for Rejection for Japanese Application No. 2003-517452 mailed Aug. 17, 2007.

* cited by examiner

*Primary Examiner*—Devon C Kramer
*Assistant Examiner*—Vikansha S Dwivedi
(74) *Attorney, Agent, or Firm*—Lowe, Hauptman, Ham & Berner, LLP

(57) ABSTRACT

A pumping arrangement for a paint circulation system comprising a reciprocating pump (13), and characterized by an alternating current induction motor (15), a rotary-to-linear motion converter (16) coupling the output of the induction motor (15) to a drive input of the pump (13), an alternating current frequency inverter (24*a*) controlling said induction motor, switch means (26) for reversing rotation of the induction motor (15) at the ends of the stroke of the reciprocating pump (13), and, a surge eliminator (28) communicating with the output side of said pump (13) to augment the pressure in the circulation system during stroke reversal of the pump.

7 Claims, 2 Drawing Sheets

PUMPING ARRANGEMENT

TECHNICAL FIELD

This invention relates to a pumping arrangement primarily, but not exclusively, for pumping liquid paint in a paint circulation system serving one or more paint spraying guns.

BACKGROUND ART

It is known to use a reciprocating piston pump to pump liquid paint around a circuit which includes a storage reservoir and one or more take-off points serving one or more paint spraying guns. Reciprocating pumps are generally preferred to rotary pumps since they are much less likely to damage the pigments and other inclusions in the liquid paint.

It is known to drive a reciprocating pump by means of fluid pressure using pneumatic or hydraulic motors. However, such motors are relatively wasteful of energy, and attempts have been made to replace fluid motors by electric motors in order to save energy, and thus minimise running costs.

A problem of reciprocating pumps is the loss of pressure at the end of the pumping stroke, when the piston of the pump undergoes stroke reversal. Even in a double-acting pump, where both forward and return strokes of the piston are pumping strokes, there is nevertheless a significant drop in supply pressure at both ends of the piston stroke. In order to minimise this problem, and also to achieve a fast response in changing the pump cycle rate when responding to changes in paint pressure in the circulation system, it is necessary to use a servo motor as the electric drive motor. The servo motor, together with its control mechanisms can achieve rapid reversal of stroke, at the ends of the pumping stroke to minimise paint pressure "fall-off" and can also respond quickly to make changes in the pump cycle rate to maintain a predetermined pressure in the paint circulating system. However, the use of a servo motor has proved to be extremely expensive. Servo motors themselves are expensive items, and require expensive ancillary control equipment including digital encoders to provide an indication, at any time instant, of the position of the piston within its stroke, a relatively complex servo control arrangement utilising specialist computer software, a complex electrical installation, and will need a high level of electrical expertise to maintain the system. Thus a servo motor driven pumping system involves a high investment cost and has proved unattractive to prospective customers notwithstanding the fact that when in use such a system could effect energy savings by comparison with conventional fluid driven motor systems.

It is an objective of the present invention to provide a system in which the aforementioned disadvantages are minimised.

DISCLOSURE OF INVENTION

In accordance with the present invention there is provided a pumping arrangement for a paint circulation system comprising a reciprocating pump, an alternating current induction motor, a rotary-to-linear motion converter coupling the output of the induction motor to the input of the pump, an alternating current frequency inverter controlling said induction motor, switch means for reversing rotation of the induction motor at the ends of the stroke of the reciprocating pump, and, a surge eliminator communicating with the output side of said pump to augment the pressure in the circulation system during stroke reversal of the pump.

It will be recognised that the provision of an alternating current induction motor as the prime mover of the pumping arrangement, controlled by an alternating current frequency inverter and switch means represents a very significantly cheaper prime mover arrangement than the known servo motor and associated control mechanism. However, the induction motor with its frequency inverter control is recognised to achieve a slower stroke reversal than car be achieved with the known servo motor arrangement, this disadvantage being overcome by the inclusion of a surge eliminator in the paint circulation system to boost the pressure in the system during stroke reversal. The combination of an alternating current induction motor together with a surge eliminator produces an effective and controllable pumping arrangement with a significant saving in initial, and maintenance costs over the known servo motor arrangement.

Desirably said pump is a double acting pump in which both forward and return strokes are pumping strokes.

Preferably said surge eliminator is an active surge eliminator.

Conveniently the volume of the gas chamber of the surge eliminator is augmented by an additional pressure chamber connected thereto.

Desirably safety switch contacts are associated with said stroke reversal switch contacts so as to be actuated in the event that the pump stroke exceeds a predetermined stroke reversal point.

Preferably there is provided a pressure transducer monitoring the pump output pressure.

Desirably there is provided a reduction gear box interposed between the motor and the converter.

BRIEF DESCRIPTION OF DRAWINGS

One example of the invention is illustrated in the accompanying drawings wherein.

BEST MODE FOR CARRYING OUT THE INVENTION

Figure 1:
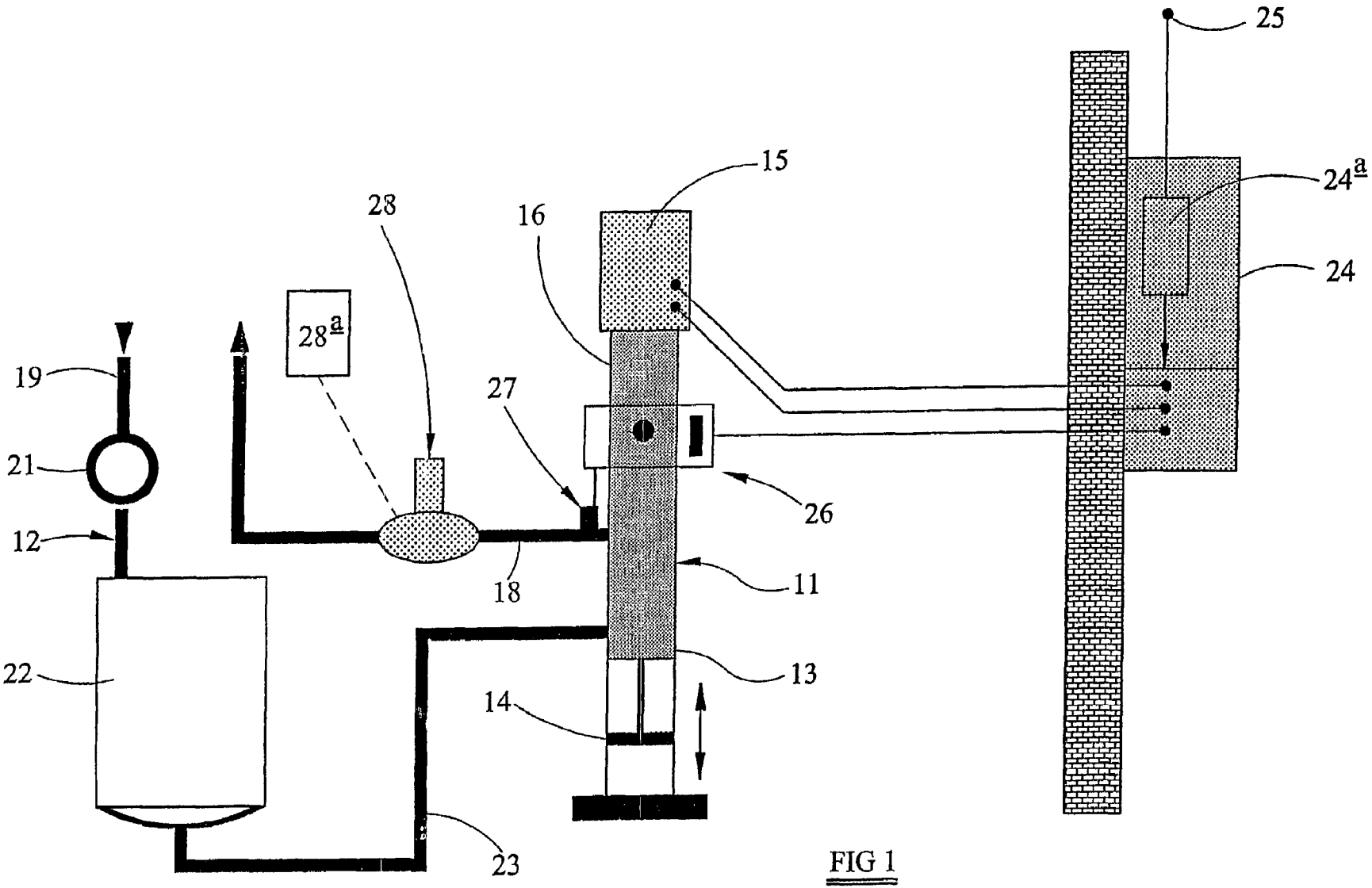
FIG. 1 is a diagrammatic representation of a pumping arrangement.
Figure 2:
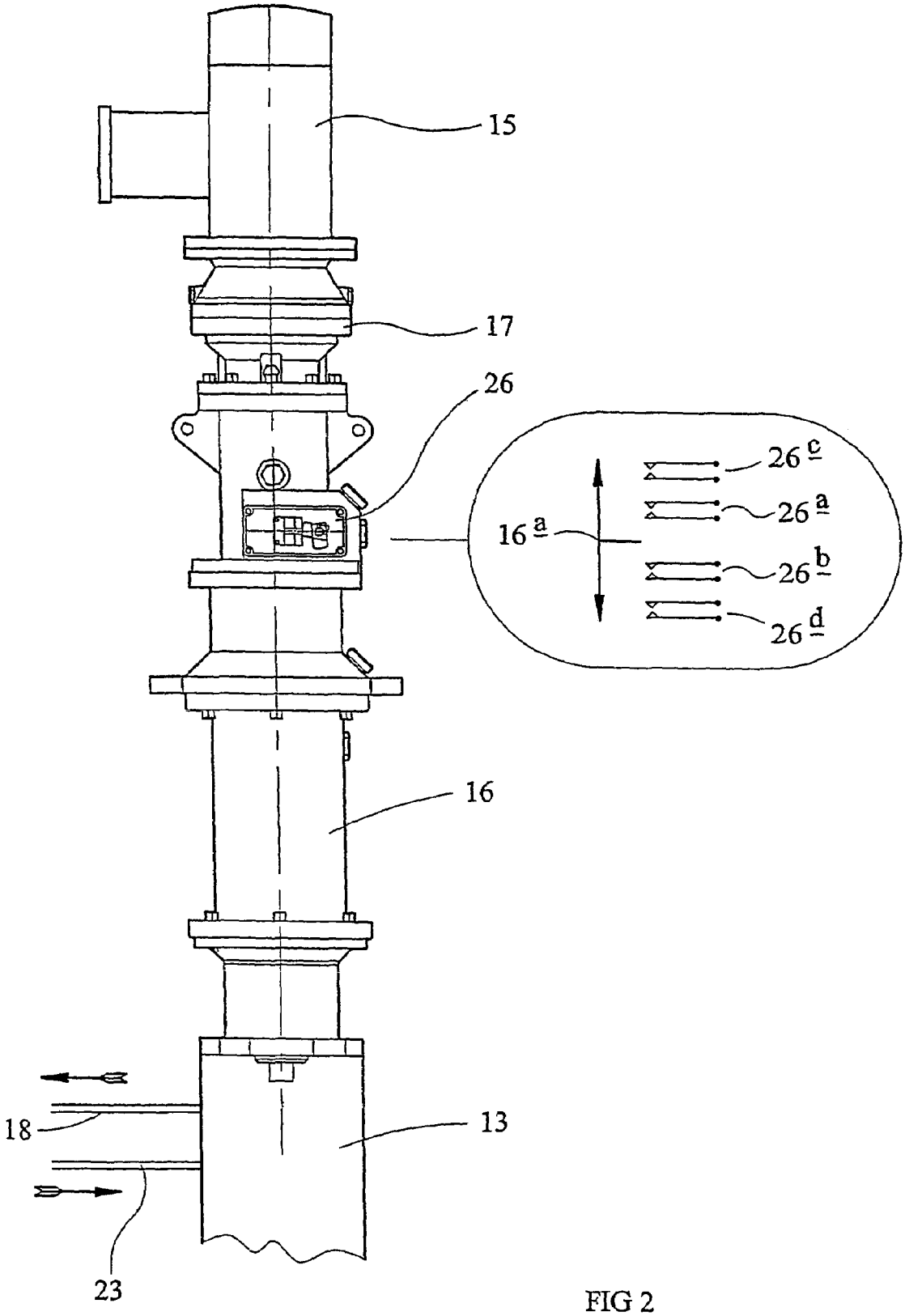
FIG. 2 is a side elevational view of part of the apparatus of FIG. 1.

Referring to the drawings, the pumping arrangement 11 provides a flow of liquid paint under pressure in a paint circulation system 12, and comprises a reciprocating piston pump 13, preferably a dual-acting pump in which both forward and return strokes of the piston 14 of the pump 13 are output pressure generating strokes. The reciprocating piston pump 13 is driven by an a.c. induction motor 15 through an actuator 16 comprising a rotary-to-linear motion converter which includes a ball or roller screw type device converting rotation of the output shaft of the induction motor 15 to rectilinear reciprocation of the piston 14 of the pump 13. Conveniently a gearbox 17 is interposed between the motor 15 and the actuator 16 to reduce the rotational speed of the output shaft of the motor 15.

The output port of the pump 13 is connected to the flow line 18 of the paint supply circuit 12 which supplies one or more spray guns (not shown). The return line 19 of the paint supply circuit includes a back pressure valve 21 and discharges into a paint reservoir or mixing tank 22 from which paint is drawn through a suction line 23 to the inlet port of the pump 13.

An induction motor control unit 24 is conveniently positioned remote from the pumping arrangement 11 and controls the supply of electrical power from an electrical supply 25 to the motor 15. Conveniently the electrical supply 25 can be a 400 volt, three phase and earth, 3 KW supply. The motor control unit 24 is used to control the main on-off functions by making, or breaking the supply of electrical power to the motor 15. Additionally however the motor control unit controls the pump cycle rate and pump reversal. Pump reversal is achieved by reversing the rotation of the motor 15. In order to achieve appropriate reversal of the motor 15 there is provided an electrical switch mechanism 26 driven by a component 16*a* of the actuator 16 which moves in unison with the piston 14 of the pump 13. The switch mechanism 26 includes first switch contacts 26*a* operated by the component 16*a* of the actuator 16 at a point corresponding to the first-end of the operating stroke of the piston 14 and second switch contacts 26*b* operated at a point corresponding to the second, opposite end of the operating stroke of the piston 14. Closure of the first or second contacts 26*a*, 26*b* sends a signal to the motor control unit 24 to effect reversal of the polarity of the power supply to the motor 15. Thus at each end of the operating stroke of the piston 14 the direction of rotation of the motor 15 is reversed and thus the stroke of the piston 14 is reversed. Additionally, the switch mechanism 26 includes safety switch contacts 26*c*, 26*d* which lie outside of the range of movement of said component of the actuator 16 to operate said first and second switch contacts 26*a*, 26*b*. The safety switch contacts 26*c*, 26*d* are not normally actuated, but in a fault situation where normal stroke reversal does not occur, then the safety switch contacts will be actuated at a point in the movement of the piston 14 which corresponds to the ultimate mechanical limit of movement of the piston, and operation of the safety switch contacts will cause the motor to be de-energised, and an alarm to be sounded. The safety switch contacts thus prevent the piston being driven inadvertently to a point at which physical damage to the pumping arrangement would occur.

It will be recognised that in practice first and second switch contacts are not essential, and a single set of reversing switch contacts could be provided, the control unit 14 including a logic circuit which reverses the polarity of the supply to the motor IS each time the reverse switch contacts are actuated.

It will be recognised that the speed of rotation of the motor 15 determines the cycle rate of the pump 13. The motor control unit includes a conventional a.c. frequency inverter 24*a* which effects the polarity reversal of the supply to the motor 15 when stroke reversal is signalled, and which also controls the supply to the motor 15 to control the speed of rotation of the motor. The control unit 24 can have a manual control device whereby the operator can set different motor speeds, and thus pump stroke rates to match the output of the pump arrangement to the requirement of the paint circulation system with which the pumping arrangement is utilised. Moreover, a pressure transducer 27 monitors the pressure at the output of the pump 13 and supplies control signals to the control unit 24. A range of operations of the transducer 27 and its interaction with the control unit 24 can be provided. For example, the transducer 27 could simply monitor pressure at the outlet of the pump 13 to ensure that the motor 15 is switched off if the pressure at the pump outlet exceeds a safe working pressure. However, the transducer 27 could also provide a signal responsive to low pressure to intiate an increase in the speed of operation of the motor 15, and thus an increase in the cycle rate of the pump 13. The design of the motor control unit to achieve such a result is well within the knowledge of the skilled man in the field of a.c. induction motor control.

Desirably the control unit 24 will have a display module whereby the operator can readily determine the operative state of the pumping arrangement, and can readily identify any fault conditions which might occur.

A disadvantage of the relatively simple a.c. induction motor/frequency inverter system is that its control over pump stroke reversal is relatively slow by comparison with that which can be achieved with the much more complex servo motor arrangement. Thus there is a danger of undesirable pressure fluctuations, particularly pressure drops, in the paint circulation system corresponding to stroke reversal of the pump 13. This disadvantage is overcome by incorporation, in the flow line. 18 from the pump 13, of a surge eliminator 28. Surge eliminators are of course well known as a device for "buffering" the pressure conditions in a paint circulation system. A simple surge eliminator in which stored pressure is discharged into the line 18 when the pressure in the line 18 falls would provide a partial solution to the problem of pressure drop in the line 18 at stroke reversal in the pump 13. However, the preferred solution is to use an active surge suppresser, conveniently of the form disclosed in our co-pending European patent application Publication No. 1079169 the content of which is imported herein by this reference. Even more preferable is to use an active surge suppresser in conjunction with an auxiliary pressure chamber 28*a* (FIG. 1), as disclosed in our co-pending European patent application Publication No. 1079170 the content of which is imported herein by this reference.

Specifically, an active surge suppression device is coupled to a supply of air or other gas under pressure and includes a dynamic valve arrangement which ensures that the diaphragm of the surge suppression device, against which hydraulic pressure in the paint line acts, is always restored quickly to an equilibrium position when reacting to pressure changes in the paint line by controlling the gas pressure at the opposite face of the diaphragm to match the hydraulic pressure. The use of an additional pressure chamber 28*a* as disclosed in co-pending Application EP 1079170 ensures that the volume of air against which the diaphragm acts is very significantly greater than the volume of the chamber of the device open to hydraulic pressure in the paint line so as to minimise the differential pressure change experienced in the air chamber resulting from flexure of the diaphragm as a result of a change in the hydraulic pressure in the paint line. It is found that the use of active surge suppression with enhanced gas volume overcomes the problems arising from the relatively slow stroke reversal by ensuring that notwithstanding the slow stroke reversal, the pressure in the paint circulation system remains at or close to the desired value.

It will be recognised that it is desirable for the control unit 24 to be remote from the pump arrangement 11, preferably in a different room of the building, particularly where an inflammable solvent is used as the paint carrier. Furthermore, in keeping with standard practice Namur barriers will be provided in the signal lines between the switch arrangement 26 and the control unit 24 to prevent any risk of sparking at the switch unit 26. Also of course the operating temperature of the motor will be monitored for example by a thermistor relay which will de-energise the motor in the event that its temperature exceeds a safe working temperature.

The invention claimed is:

1. A pumping arrangement for a paint circulation system comprising:

a reciprocating pump and an alternating current induction motor, a rotary-to-linear motion converter coupling an output of the induction motor to a drive input of the pump, an alternating current frequency inverter controlling said induction motor, a switch for reversing rotation of the induction motor at the ends of the stroke of the reciprocating pump, and, a surge eliminator communicating with the output side of said pump to augment the pressure in the circulation system during stroke reversal of the pump.

2. A pumping arrangement as claimed in claim 1 wherein said surge eliminator is an active surge eliminator.

3. A pumping arrangement as claimed in claim 1 wherein a volume of a gas chamber of the surge eliminator is augmented by an additional pressure chamber connected thereto.

4. A pumping arrangement as claimed in claim 1 wherein safety switch contacts are associated with said stroke reversal switch contacts so as to be actuated in the event that the pump stroke exceeds a predetermined stroke reversal point.

5. A pumping arrangement as claimed in claim 1 further comprising a pressure transducer monitoring the pump output pressure.

6. A pumping arrangement as claimed in claim 1 wherein said pump is a double acting pump in which both forward and return strokes are pumping strokes.

7. A pumping arrangement as claimed in claim 1 further comprising a reduction gear box, interposed between the motor and the converter.

* * * * *